United States Patent [19]

Kinghorn et al.

[11] Patent Number: 4,596,266

[45] Date of Patent: Jun. 24, 1986

[54] SAFETY VALVE AND SYSTEM FOR HYDROCARBON STORAGE TANKS

[76] Inventors: Robert E. Kinghorn, 11425 Slash Pine Pl., The Woodlands, Tex. 77380; Max Schulze, 2802 S. Fruitland, Kennewick, Wash. 99337

[21] Appl. No.: 656,279

[22] Filed: Oct. 1, 1984

[51] Int. Cl.[4] ..... B65D 88/38

[52] U.S. Cl. ..... 137/172; 137/392; 220/219

[58] Field of Search ..... 137/172, 392; 220/219

[56] References Cited

U.S. PATENT DOCUMENTS

| | | | |
|---|---|---|---|
| 2,295,097 | 9/1942 | Waugh | 137/172 X |
| 3,564,527 | 2/1971 | Lerner | 220/219 X |
| 4,202,366 | 5/1980 | Kamvachirapitag | 220/219 X |
| 4,336,821 | 6/1982 | Frantz | 137/392 X |

*Primary Examiner*—Alan Cohan

*Attorney, Agent, or Firm*—Neal J. Mosely

[57] ABSTRACT

A safety valve and system is disclosed for hydrocarbon storage tanks having a floating roof construction and provision for drainage of water from the floating roof. The floating roof is constructed to collect water on top and discharge the same through a drain connected to a flexible drain line leading to an outlet opening. If the flexible line should break or otherwise become open to the contents of the tank, there is danger of leakage of the contents from the tank with attendant environmental danger and danger of fire. This invention comprises a valve which responds automatically to the presence or absence of water in the drainage line and is closed in the absence of water or the presence of hydrocarbons in the valve. The valve is motor operated electrically by storage batteries which are recharged by a solar panel. When the valve is empty of water or filled with hydrocarbons, sensors cause the valve to close. A pressure sensor mounted on the inlet conduit closes the automatic system at a selected pressure and does not allow the valve to open until it is manually overridden. A back-up battery fail in case of failure of the primary battery.

37 Claims, 8 Drawing Figures

SAFETY VALVE AND SYSTEM FOR HYDROCARBON STORAGE TANKS

BACKGROUND OF THE INVENTION

1. Field of the Invention

This invention relates to safety equipment for floating roof tanks for hydrocarbons, and more particularly to a control system and valve responsive to the presence of water and pressure within the system to prevent discharge of hydrocarbons through the water drainage outlet.

2. Brief Description of the Prior Art

Open top floating roof tanks are used to store highly flammable liquids, e.g. hydrocarbons, at atmospheric pressure. They are used for storing such materials as gasoline, crude oil, diesel fuel, and various end cuts of the refining process. Each of these tanks are equipped with a roof drain system permitting the flow of rain water from the roof through a flexible connection to a drain outlet near the base of the tank. The drain outlet is connected to a normally closed gate valve. The normally closed valve is to insure that valuable and hazardous hydrocarbon product is not lost at the drain due to a malfunction or leakage in the flexible drain line. As a result, men must be sent to the tank location during a rain to open the valve. Failure to open the valve can, and often does, cause the roof to become so heavy that it will collapse, creating a safety and operations problem. The tank must be taken out of use, drained of all product, cleaned, and repaired all at great expense.

Lerner et al U.S. Pat. No. 3,564,527 discloses an alarm scheme for waste fluid drains comprising a continuously filled sampling conduit which samples the fluid flowing in a drain pipe. The electrical conductivity of the fluid is continuously monitored and on a selected change in conductivity, an alarm device is energized to provide an alarm indication.

Tolin U.S. Pat. No. 2,924,756 discloses an indicating and control probe which will detect materials in terms of their dielectric properties. The detecting circuit comprises a single vacuum tube oscillator having a control device in the plate circuit. Continuous oscillations result in sufficient current flowing through the plate circuit to energize an indicating or control device.

Jarzembski U.S. Pat. No. 2,932,315 discloses a fluid level control system having a transistorized circuit which uses the electrical power supplied by a battery. An electrical capacitor, formed by an electrode and the wall of the container has its value of capacitance determined by the physical proximity of the fluid to a probe electrode. The dielectric constant of the fluid, as the level of the fluid rises to the probe will change the output. The probe capacitance is sensed by the circuit and translated into an electrical current. The result is a positioning of a valve in accordance with the physical distance between the probe and the fluid level in order to maintain that distance at a predetermined value.

Jennings U.S. Pat. No. 3,074,587 discloses an automatic drain for a floating roof tank in which a valve can be maintained in a closed position when there is insufficient water in the drain hose to require immediate draining. The valve will open when water in the hose exceeds a level whereby its static pressure is greater than the static pressure of the liquid in the tank.

Seney U.S. Pat. No. 2,861,159 discloses the determination or control of liquid level by the use of a temperature sensitive probe.

The prior art in general does not disclose a valve and system which shuts off the outlet water drain from a floating roof tank in the absence of water or the presence of hydrocarbons.

SUMMARY OF THE INVENTION

It is therefore an object of the present invention to provide an automatic drain for a floating roof tank for hydrocarbons which will be normally closed when it is not raining, yet will open when there is water to be drained from said roof.

Another object of this invention is to provide an automatic drain for a floating-roof tank for hydrocarbons which will prevent hydrocarbons from draining should a leak in the drain system occur.

Another object of this invention is to provide an automatic drain for a floating roof tank which requires no power source at the tank location.

Another object of this invention is to provide an automatic drain for a floating roof tank having a self contained power supply and a back-up power supply both recharged by solar energy.

Another object of this invention is to provide a drain for a floating roof tank which will signal the operation of the back-up power supply so that the primary power supply may be replaced.

Another object of this invention is to provide a drain for a floating roof tank which will reduce the possibility of roof failure as a result of water loads.

Another object of this invention is to provide a drain for a floating roof tank which will reduce the labor force required for drainage operations.

Other objects of the invention will become apparent from time to time throughout the specification and claims as hereinafter related.

The above noted objects and other objects of the invention are accomplished by a valve which responds automatically to the presence or absence of water in the drainage line and is closed in the absence of water or the presence of hydrocarbons in the valve. The valve is motor operated electrically by storage batteries which are recharged by a solar panel. When the valve is empty of water or filled with hydrocarbons, sensors cause the valve to close. A pressure sensor mounted on the inlet conduit closes the automatic system at a selected pressure and does not allow the valve to open until it is manually overridden. A back-up battery fall in case of failure of the primary battery.

DESCRIPTION OF THE PREFERRED EMBODIMENT

Figure 1:
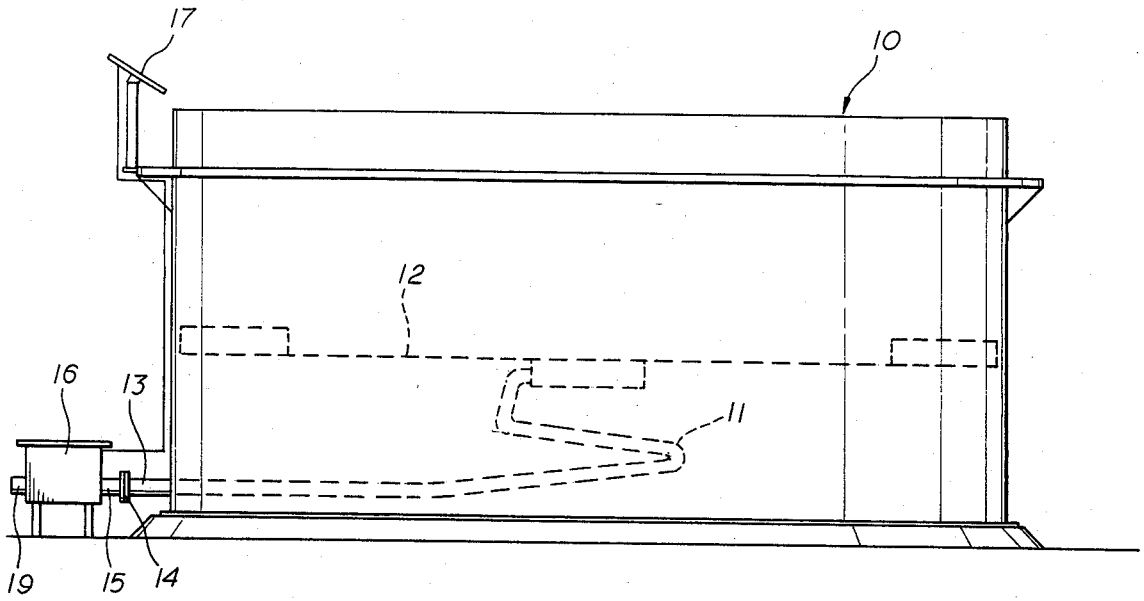
FIG. 1 is a partially schematic elevational view of a drain system for carrying off rainwater from the roof of a hydrocarbon storage tank, illustrating various components of the invention.

Referring to the drawing by numerals of reference, and particularly to FIG. 1, there is shown a floating roof type hydrocarbon storage tank 10 having a flexible drain conduit 11 for carrying off rainwater from the roof 12. The drain conduit 11 extends from the roof 12 to a drain 13 near the bottom of the tank 10. The drain 13 has a flanged end which is connected to the flange 14 of conduit 15 on a housing box 16 for the components of the system. A solar panel 17 is positioned near the top of the tank 10 and oriented for maximum utilization of the sun light.

Figure 2:
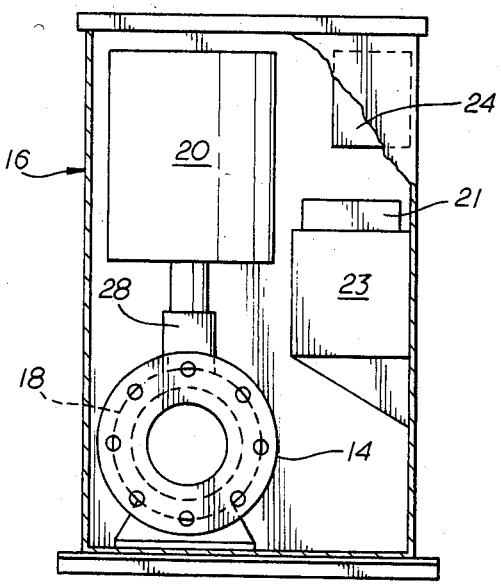
FIG. 2 is a right elevation, partially in cross section, of the water sensing valve and other components disposed within a container box.
Figure 3:
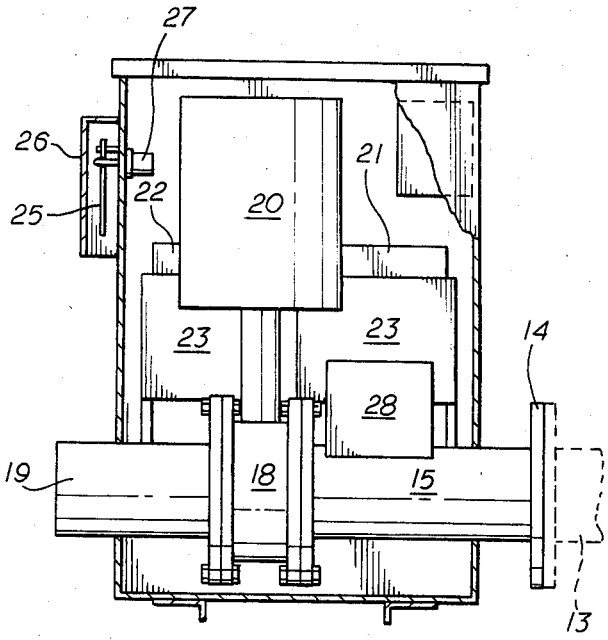
FIG. 3 is a front elevation view, partially in cross section, showing the water sensing valve and other components disposed within a container box.
Figure 4:
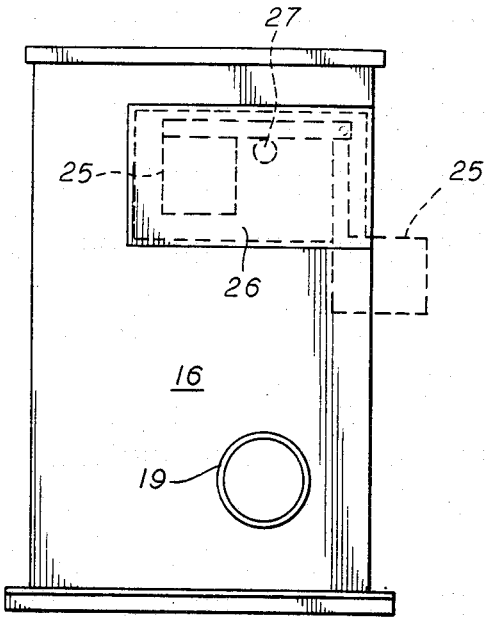
FIG. 4 is a left elevation of the container box showing the signal device of the drainage system.

Referring now to FIGS. 2, 3, and 4, the housing 16 encloses a water discriminating gate valve 18 having its inlet connected to the flanged conduit 15 and its outlet connected to discharge conduit 19. An electric motor operator 20 is attached to the valve 18 which moves the valve to an open position from a normally closed position. A primary storage battery 21 and a back-up battery 22 are secured by brackets 23 in the housing 16. An optional 110V. AC battery charger 24 (FIG. 5) may be provided in the housing 16 if the system is used adjacent to a conventional power supply.

A pivotally mounted signal flag 25 is normally retracted within a small housing 26 on one side of the housing 16 and is exposed when current is directed to a solenoid 27 upon loss of the primary power source.

A control box 28 which contains the electronic circuitry (hereinafter described) is mounted on the inlet conduit 15 and connected to dielectric sensor probes and a pressure sensor (not shown) also mounted on the conduit 15.

Figure 5:
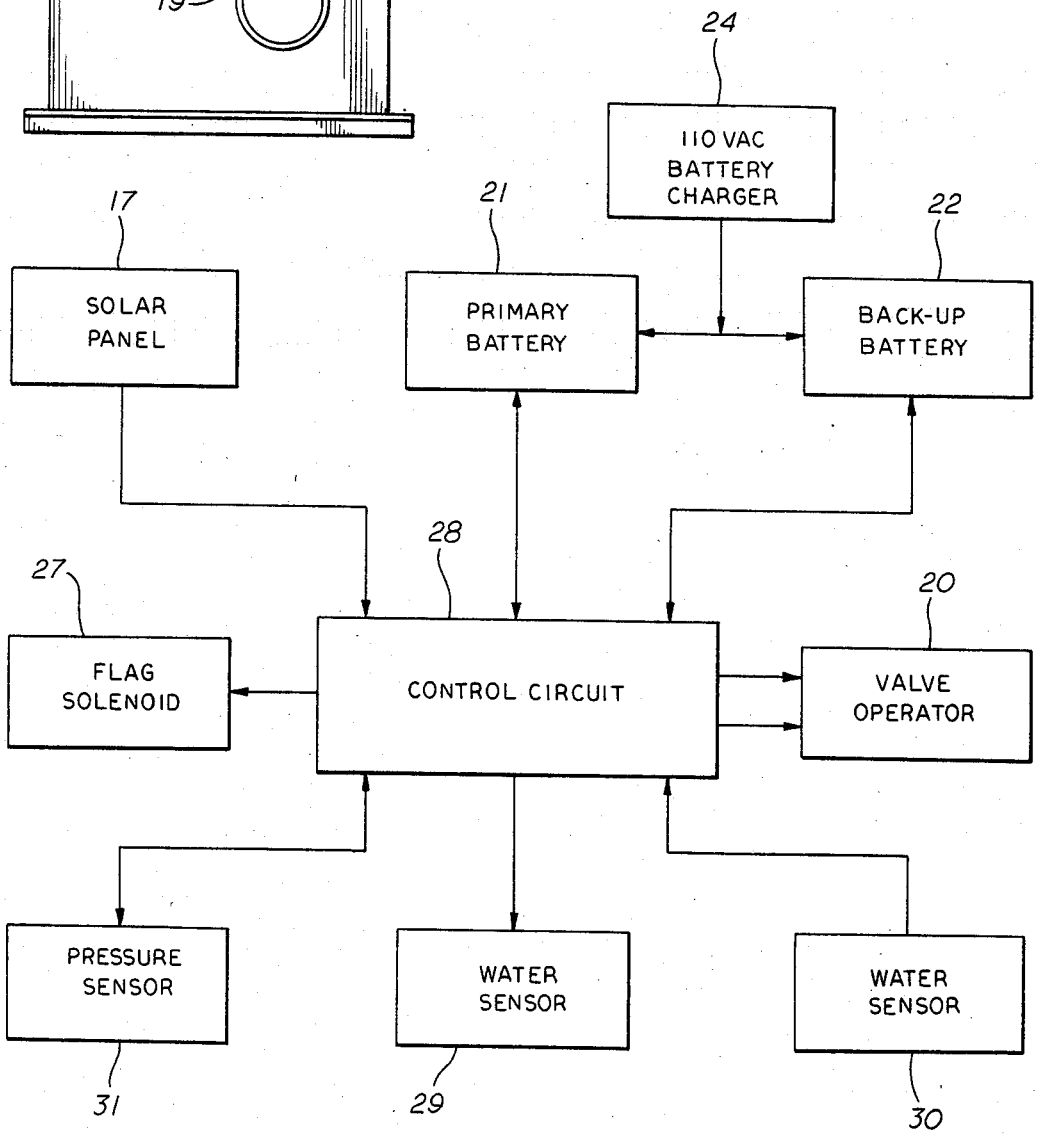
FIG. 5 is a diagrammatic illustration of the valve control system.

FIG. 5 is a schematic diagram of the valve control system. The control box 28 containing the electronic circuitry is powered by the primary 12 V. D.C. lead-acid battery 21 which is continuously recharged by the solar panel 17. A pair of sensor probes 29 and 30 energized by the primary battery 21 monitor the contents of the inlet conduit. The valve is in a normally closed position and when precipitation occurs, the resultant drainage will run through the drain line system to the sensor probes 29 and 30 and stop at the closed valve. The sensor probes 29 and 30 will detect water and signal the valve motor operator 20 to open the valve.

When precipitation stops, the head of water in the line to the sensors 29 and 30 will keep the valve 18 open. Should hydrocarbon product from the tank enter the inlet conduit 11, it will stop at the closed valve 18. The hydrocarbons are not electrically conductive and so the sensors 29 and 30 will not signal the valve to open. A pressure sensor 31 mounted on the inlet conduit monitors the pressure therein, and when the pressure exceeds 1.5 pounds, a signal is generated which closes the automatic system and for safety purposes does not allow the valve to open until it is manually overridden.

Should the primary power source fail, the secondary battery 22 which is also recharged by the solar panel 17 is activated to close the valve if open, activates the flag solenoid 27 to drop the signal flag, and closes the system to any other signal other than a manual override.

Figure 6:
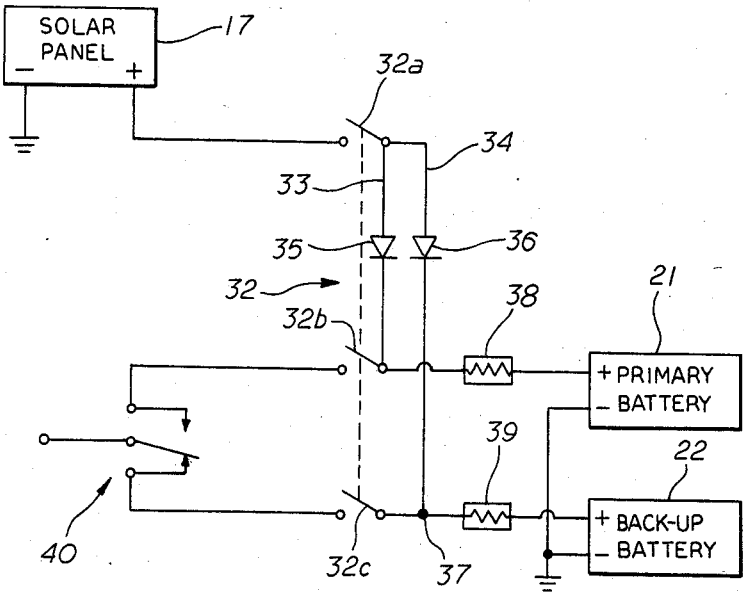
FIG. 6 is an electrical schematic diagram of the power supply and recharging portion of the system.

FIG. 6 shows the power supply and recharging portion 32 of the circuit. Charging power flows from the solar panel 17 to contact 32*a* of switch 32 and from there into parallel leads 33 and 34. Protector diode 35 is connected between terminal 32a and contact 32*b* of switch 32 by lead 33. Another protector diode 36 is connected between contact 32*a* and junction 37 by lead 34. Contact 32*b* is connected through current limiting resistor 38 to the positive terminal of the primary battery 21, and junction 37 is connected through current limiting resistor 39 to the positive terminal of the back-up battery 22 and to contact 32*c* of switch 32. Contact 32*b* of switch 32 is connected to the normally open contact of electromechanical relay 40. Junction 37 is connected through contact 32*c* of switch 32 to the normally closed contact of the relay 40. By the circuit previously described, under normal sunlight conditions, solar panel 17 will generate an electrical current to supply the batteries 21 and 22 with a constant charge.

Figure 7:
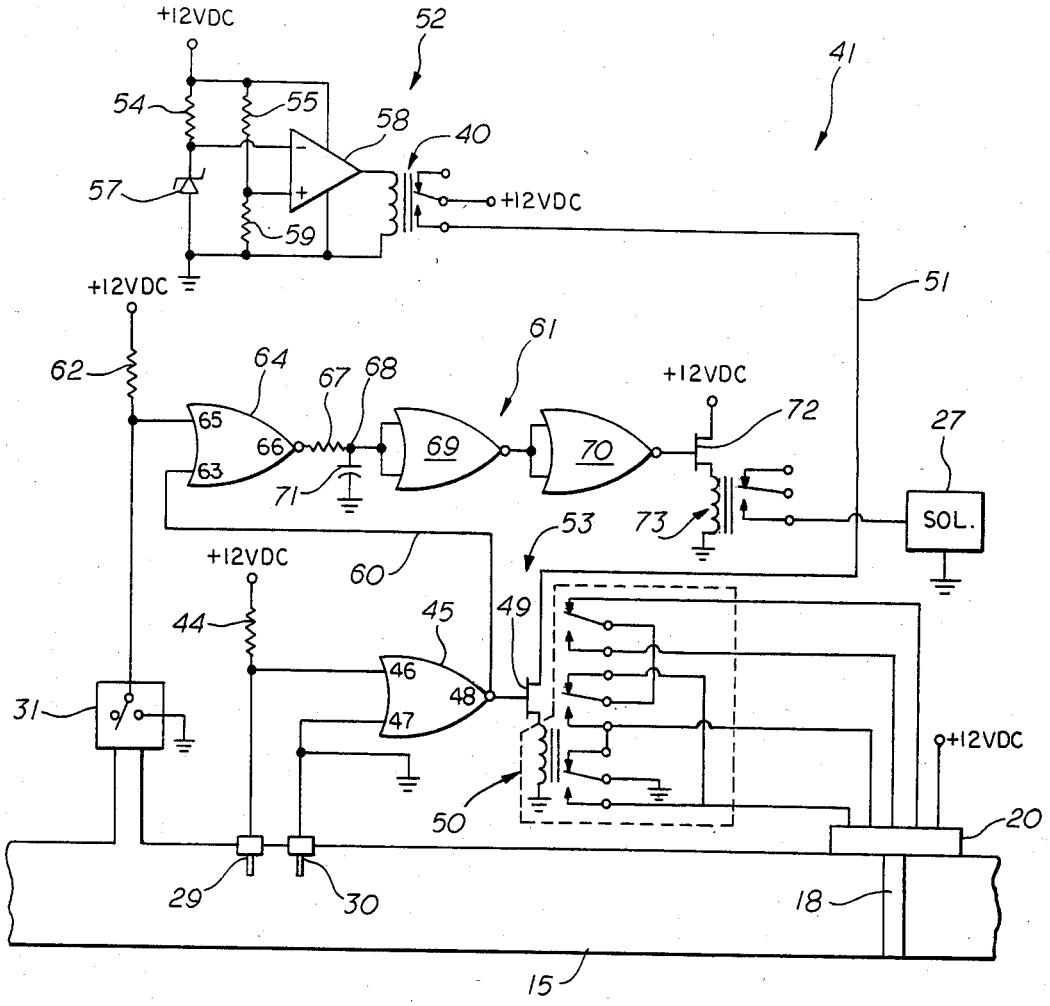
FIG. 7 is an electrical schematic diagram of the control portion of the system.

FIG. 7 shows the control portion 41 of the circuit. The control circuit 41 continuously monitors the electrical conductivity of the contents of the inlet conduit 15 by means of a pair of water sensor probes 29 and 30 which are charged by 12 V DC current passing through a current limiting resistor 44. A NOR gate 45 has input pin 46 connected between resistor 44 and the sensor probe 29 and inlet pin 47 connected to sensor probe 30 and ground. The outlet pin of gate 45 is connected to the base of an NPN field effect transistor 49. The collector of transistor 49 is connected to a 4PDT relay 50. The emitter of transistor 49 is connected by lead 51 to the low power detector circuit (described hereinafter). The other end of relay 50 is connected to ground. Relay 50 is provided with four leads which are appropriately connected to the valve motor operator 20.

A 12 V DC lead supplies power for the motor operator 20. When the water level inside inlet conduit 15 rises, current flows between the sensor probes 29 and 30 due to the high conductivity of water to activate relay 50 which signals the motor operator 20 to open the valve. When the water level decreases, the sensor probes 29 and 30 will send another signal to activate relay 50 and signal the motor operator 20 to close the valve.

The control circuit 41 contains a low battery detector circuit 52 connected by lead 51 to the normally open pin of electromechanical relay 53. The detector circuit comprises a 12 V DC power source coupled to resistor 54, a resistor 55, and power input amplifier 56 arranged in parallel. Resistor 54 is connected in series with zener diode 57 which is connected to ground. A lead disposed between resistor 54 and zener diode 57 attaches to the negative pin of amplifier 58. This arrangement controls the reference voltage of the amplifier power supply. Resistor 55 is connected in series with resistor 59 which is grounded. A lead disposed between resistors 55 and 59 attaches to the positive pin of amplifier 58. The output pin of amplifier 58 is connected to one terminal of electromechanical relay 53 and the opposing terminal is connected to ground and to the bottom lead of amplifier 58. If a drop in the primary power supply (battery 21) occurs, the amplifier 58 will send a signal which energizes relay 53 to establish a contact between the back-up battery 22 and lead 51. Power from the back-up battery 22 will energize relay 50 which will command the motor operator 20 to close the valve (if open). Simultaneously, a signal will be sent through lead 60 to activate solenoid control circuit 61 which energizes the solenoid 27 to drop the signal flag or optionally sound an alarm.

The pressure control override function is performed by the pressure sensor 31 attached to the inlet conduit 15. A current-limiting resistor 62 is connected between the 12 V DC supply and the sensor 31. A lead connected between resistor 62 and the sensor 31 attaches to pin 63 of NOR gate 64. Lead 60 is connected to pin 65 of gate 64. Output pin 66 is connected in series to resistor 67, junction 68, NOR gate 69, and NOR gate 70. Capacitor 71 is connected between junction 68 and ground. Gate 70 is connected to the base of NPN field effect transistor 72. The emitter of transistor 72 is connected to a 12 V DC source and the its common terminal connected to electromechanical relay 73.

If the drain line system allows hydrocarbon product to flow through the conduit 15, the product will stop at the closed valve. Water sensor probes 29 and 30 will not transmit a signal due to the non-conductivity of the product. Should the pressure inside the conduit 15 exceed a predetermined amount such as 1.5 pounds, the pressure sensor 31 will send a signal through NOR 64 to output pin of gate 45 and will override the automatic opening system. In this manner, the valve will not open until it is manually opened or the override switch is operated. NOR gates 64, 69, and 70 together with transistor 72 and relay 73 conform the elements of the alarm control circuit 61. When the back-up battery 22 is activated, a signal will be carried through lead 60 activating relay 73 which will operate the solenoid 27 to drop the signal flag or to sound an alarm.

AN ALTERNATE EMBODIMENT

Figure 8:
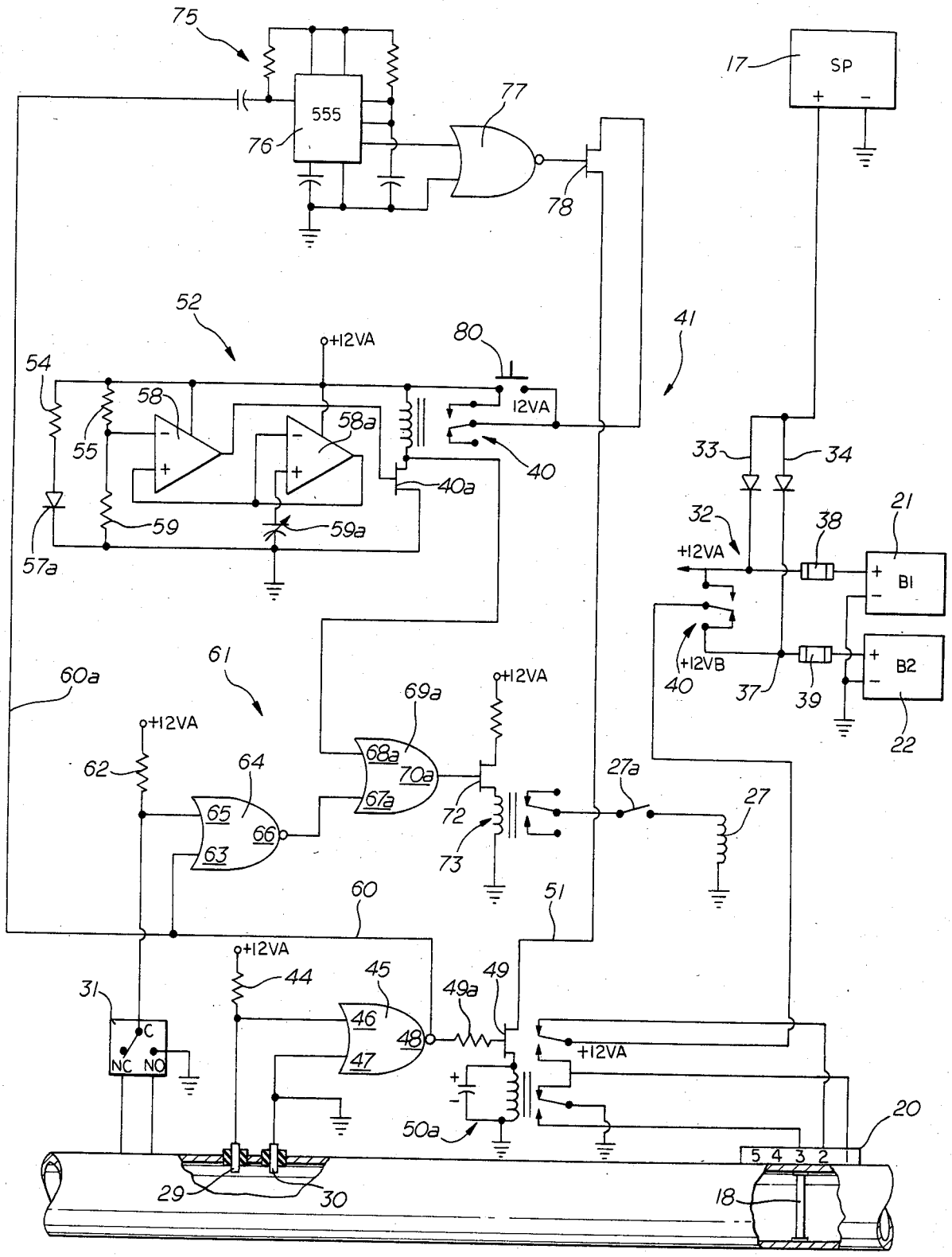
FIG. 8 is an electrical schematic of another embodiment of the system.

In FIG. 8, the power supply and recharging portion 32 of the circuit is shown combined with the rest of the control circuit which has been modified to include a timing circuit for timed operation of the motor actuator 20 to avoid excessive wear from continuous operation of the actuator. Since most of this circuit is the same as that shown in FIGS. 6 and 7, the same reference numerals are used for like components.

The solar panel 17 is connected to parallel leads 33 and 34 which connect through resistors 38 and 39 to the positive terminals of back-up batteries 21 and 22. Lead 33 also connects to the normally open contact of electromechanical relay 40. Lead 34 connects to junction 37 which is connected to the normally closed contact of the relay 40. By the circuit previously described, under normal sunlight conditions, solar panel 17 will generate an electrical current to supply the batteries 21 and 22 with a constant charge.

The left side of FIG. 8 shows the control portion 41 of this embodiment of the control circuit. The control circuit 41 continuously monitors the electrical conductivity of the contents of the inlet conduit 15 by means of a pair of water sensor probes 29 and 30 which are charged by 12 V DC current (originating with solar panel 17 or back-up batteries 21 and 22) passing through a current limiting resistor 44.

A NOR gate 45 has input pin 46 connected between resistor 44 and the sensor probe 29 and inlet pin 47 connected to sensor probe 30 and ground. The outlet pin of gate 45 is connected to the base of an NPN field effect transistor 49 through resistor **49*a*. The collector of transistor 49 is connected to a 2PDT relay 50*a*. The emitter of transistor 49 is connected by lead 51 to the low power detector circuit (described hereinafter). The other end of relay 50*a* is connected to ground. Relay 50 is provided with leads which are connected to the valve motor operator 20, to relay 40**, and to ground.

A 12 V DC power for the motor operator 20 is provided by the connections through relays 40 and **50*a*. When the water inside inlet conduit 15 contacts sensor probes 29 and 30, current flows between the probes through the water to activate relay 50*a* which energizes the motor operator 20 to open the valve. When the water level decreases, the interruption of current flow between sensor probes 29 and 30 will cause relay 50*a* to energize the motor operator 20** to close the valve.

Control circuit 41 contains a low battery detector circuit 52 connected by lead 51 through NPN fiels effect transistor 78 to the normally open pin of electromechanical relay 53. Nromally open starting switch 80 is connected in parallel with the contacts of relay 40. The detector circuit comprises 12 V DC power from back-up batteries 21 and 22 coupled to resistor 54, a resistor 55, and power input amplifier 58 arranged in parallel. Resistor 54 is connected in series with diode **57*a* which is connected to ground. A lead disposed between resistors 55 and 59 attaches to the negative pin of amplifier 58**. This arrangement controls the reference voltage of the amplifier power supply.

Resistor 55 is connected in series with resistor 59 which is grounded. A lead from the positive pin of amplifier 58 is connected to the output pin and to the negative pin of amplifer **58*a*. The positive pin of amplifier 58*a* is grounded through capacitor 59*a*. The output pin of amplifier 58 is connected to the base of NPN field effect transistor 40*a* connected at one end of the coil of relay 40**.

If a drop in the primary power supply (battery 21) occurs, the amplifiers 58 and 58a will send a signal which energizes relay 40 to establish a contact between the back-up battery 22 and lead 51. Power from the back-up battery 22 will energize relay **50*a* which will energize the motor operator 20 to close the valve (if open). Simultaneously, a signal will be sent through lead 60 to activate solenoid control circuit 61 which energizes the solenoid 27** to drop the signal flag or optionally sound an alarm.

The pressure control override function is performed by the pressure sensor 31 attached to the inlet conduit 15. A current-limiting resistor 62 is connected between the 12 V DC supply and the sensor 31. A lead connected between resistor 62 and the sensor 31 attaches to pin 65 of NOR gate 64. Lead 60 is connected to pin 63 of gate 64. Output pin 66 is connected to the pin **67*a* of OR gate 69*a*. Pin 68*a* of OR gate 69*a* is connected to one side of the coil of relay 40. The output pin 70*a* of OR gate 69*a* is connected to the base of NPN field effect transistor 72. The emitter of transistor 72 is connected to a 12 V DC source and the its common terminal connected to the coil of electromechanical relay 73. The contacts of relay 73 are connected to 12 V DC power and through a mercury switch 27*a* to alarm solenoid 27** and ground.

Lead **60*a*, from pin 63 or NOR gate 64 is connected to timing circuit 75. The timing circuit 75 includes IC Timer chip 76 (a 555 timing chip) connected to NOR gate 77 and thence to the base of NPN field effect transistor 78**.

If the drain line system allows hydrocarbon product to flow through the conduit 15, the product will stop at the closed valve. Water sensor probes 29 and 30 will not transmit a signal due to the non-conductivity of the product. Should the pressure inside the conduit 15 exceed a predetermined amount such as 1.5 pounds, the pressure sensor 31 will send a signal through NOR gate 64 to output pin of gate 45 and will override the automatic opening system. In this manner, for safety purposes, the valve will not open until it is manually opened or the override switch is operated. NOR gate 64 and OR gate 70 together with transistor 72 and relay 73 conform the elements of the alarm control circuit 61. When the back-up battery 22 is activated, a signal will be carried through lead 60 activating relay 73 which will operate the solenoid 27 to drop the signal flag or to sound an alarm. The timing circuit 75 causes the motor actuator 20 for the valve 18 be energized no more than 25% of the time to reduce the chance of motor failure.

OPERATION

The valve 18 is in a normally closed position and when precipitation occurs, the resultant drainage will run through the drain line system to the water sensor probes and stop at the closed valve. The sensor probes will detect water and signal the valve motor operator to open the valve. When precipitation stops, the water head in line 11 at the sensors 29 and 30 will continue to produce a signal to the motor operator to keep the valve 18 open.

Should hydrocarbon product from the tank enter the inlet conduit, it will stop at the closed valve. The sensor probes are not sensitive to the hydrocarbon product and will not signal the valve to open. At the start up of the system, or at any other time that the line 11 is empty of water, the sensors 29 and 30 will not be conducting and the valve 18 will be closed. A pressure sensor mounted on the inlet conduit monitors the pressure therein, and when the pressure exceeds 1.5 pounds, a signal is generated which closes the automatic system and does not allow the valve to open until it is manually overridden or the override switch is operated.

Should the primary battery fail, the secondary battery which is also recharged by the solar panel is activated to close the valve if open, activate the flag solenoid to drop the signal flag, and close the system to any other signal other than a manual override.

While this invention has been described fully and completely with special emphasis upon a preferred embodiment, it should be understood that within the scope of the appended claims the invention may be practiced otherwise than as specifically described herein.

We claim:

1. A safety system for a hydrocarbon storage tank having a floating roof, a water drain in said roof, a drain opening from said tank, and a flexible line connecting said roof drain to said tank drain for carrying off rain water collected on said floating roof and preventing leakage of hydrocarbon liquid and through said tank drain, said system comprising;

an electrically-operated, normally-closed valve means connected in said tank drain, means responsive to pressure in said system exceeding a predetermined amount to maintain said valve means in a closed position for safety purposes until overridden, means responsive to the electrical conductivity of liquid on the inlet side of said valve means to detect the presence of water therein, and electric circuit means interconnecting said conductivity-responsive means and said electrically-operated valve means and operable to energize said valve means to open the same on detection of the presence of water in the inlet thereto.

2.

A safety system for a hydrocarbon storage tank having a floating roof, a water drain in said roof, a drain opening from said tank, and a flexible line connecting said roof drain to said tank drain for carrying off rain water collected on said floating roof and preventing leakage of hydrocarbon liquid and through said tank drain, said system comprising;

an electrically-operated, normally-closed valve means connected to said tank drain, means responsive to the electrical conductivity of liquid on the inlet side of said valve means to detect the presence of water therein, electric circuit means interconnecting said conductivity-responsive means and said electrically-operated valve means and operable to energize said valve means to open the same on detection of the presence of water in the inlet thereto, a primary power supply for operating said valve means, a secondary power supply operative in responsive to the failure of said primary power supply for operating said valve means, and an external power source for continuously charging said primary and secondary power supply.

3. A system according to claim 2 in which said external power source comprises solar electric power generating means supported adjacent to said system.

4. A system according to claim 2 including means responsive to the operation of said secondary power supply for signaling its operation and maintaining said valve means in a closed position, and means responsive to the pressure in said system exceeding a predetermined limit for maintaining said valve means in a closed position.

5. A system according to claim 4 in which said means responsive to electrical conductivity for detecting the presence of water in said drain line comprises a pair of electrodes extending into the interior of the inlet of said valve means, means connecting a source of direct current between said electrodes, and means responsive to the flow of current between said electrodes through said water.

6. A system according to claim 4 in which means sensing the pressure in such system comprises pressure sensing means in communication with the interior of the inlet of said valve means, means connecting a source of direct current to said device, and means responsive to the pressure above a predetermined level for by-passing said means for continuously measuring electrical conductivity.

7. A system according to claim 2 in which said primary power supply comprises a storage battery.

8. A system according to claim 2 in which said secondary power supply comprises a storage battery.

9. A system according to claim 2 in which said electrically operated valve means comprises a gate valve and electric motor operatively connected thereto.

10. A system according to claim 2 including
a timing circuit operable to limit the time that said electrically operated valve means is energized to selected time intervals.

11. A system according to claim 2 in which
said secondary source of power includes two alternate power sources, and
circuit means for detecting a selected decrease in power from one of said alternate power sources and switching to said other power source.

12. A system according to claim 2 in which
said secondary source of power includes two alternate power sources,
circuit means for detecting a selected decrease in power from one of said alternate power sources and switching to said other power source, and
a timing circuit operable to limit the time that said electrically operated valve means is energized to selected time intervals.

13. A system according to claim 2 including
a normally-open, motor-operated gate valve positioned in said drain,
an electric motor operatively connected to said valve and operable to open and close the same,
a pair of sensors positioned in the inlet to said valve to detect electric conductivity of liquid therein and permitting a flow of current when immersed in water,
an electric relay connected to said motor and operable to energize said motor to move said valve to an open or a closed position,
a plurality of NOR gates and a field effect transistor interconnected in circuit with said sensors and said relay and operable on current flow between said sensors in the presence of water to actuate said relay to energize said motor to open said valve and operable in the absence of current flow between said sensors to energize said motor to close said valve.

14. A system according to claim 13 including
pressure responsive means positioned in the inlet to said valve to respond to pressure therein and including means operatively connected to one of said NOR gates whereby the occurrence of a selected pressure effects operation of said relay to energize said motor to close said valve.

15. A system according to claim 13 including
a signal flag,
an electric solenoid operatively connected to said signal flag to operate the same,
a second electric relay connected in circuit with said solenoid and said NOR gates and operable in response to energization of said first relay for closing said valve to energize said solenoid to move said flag to provide a visual signal of the valve closing.

16. A system according to claim 13 in which
one of said NOR gates has its output connected to the collector of said transistor and has its input from said sensors,
one additional NOR gate and an OR gate being connected in series,
said pressure responsive means being connected to one input to said first NOR gate, and
the output from said one NOR gate being connected to the other input to said first NOR gate.

17. A system according to claim 13 including
a signal flag,
an electric solenoid operatively connected to said signal flag to operate the same,
one of said NOR gates has its output connected to the collector of said transistor and has its input from said sensors,
three additional NOR gates being connected in series with the output from the first and second gate being connected to the input to the second and third gates,
said pressure responsive means being connected to one input to said first NOR gate,
the output from said one NOR gate being connected to the other input to said first NOR gate, and
a second electric relay connected in circuit with said solenoid and said third NOR gate and operable in response to energization of said first relay for closing said valve to energize said solenoid to move said flag to provide a visual signal of the valve closing.

18. A system according to claim 13 including
a primary direct current battery connected to provide current for said system,
a secondary direct current battery connected to provide current for said system,
a switch connected to said batteries to select the battery supplying current to said system, and
solar electric powr generating means connected to said batteries to charge the same.

19. A system according to claim 2 including
a normally-open, motor-operated gate valve positioned in said drain,
an electric motor operatively connected to said valve and operable to open and close the same,
a pair of sensors positioned in the inlet to said valve to detect electric conductivity of liquid therein and permitting a flow of current when immersed in water,
an electric relay connected to said motor and operable to energize said motor to move said valve to an open or a closed position,
a plurality of NOR gates, an OR gate, and a field effect transistor interconnected in circuit with said sensors and said relay and operable on current flow between said sensors in the presence of water to actuate said relay to energize said motor to open said valve and operable in the absence of current flow between said sensors to energize said motor to close said valve.

20. A system according to claim 19 including
pressure responsive means positioned in the inlet to said valve to respond to pressure therein and including means operatively connected to one of said NOR gates whereby the occurrence of a selected pressure effects operation of said relay to energize said motor to close said valve.

21. A system according to claim 19 including
a signal flag,
an electric solenoid operatively connected to said signal flag to operate the same,
a second electric relay connected in circuit with said solenoid and said one NOR gate and said OR gate and operable in response to energization said solenoid to move said flag to provide a visual signal of the valve closing.

22. A system according to claim 19 in which
one of said NOR gates has its output connected to the collector of said transistor and has its input from said sensors, one of said NOR gates and said OR gate being connected in series, said pressure responsive means being connected to one input to said first NOR gate, and the output from said one NOR gate being connected to the other input to said first NOR gate.

23. A system according to claim 19 including a signal flag, an electric solenoid operatively connected to said signal flag to operate the same, one of said NOR gates has its output connected to the collector of said transistor and has its input from said sensors, one of said NOR gates and said OR gate being connected in series with the output from said NOR gate being connected to the input to said OR gate, said pressure responsive means being connected to one input to said first NOR gate, the output from said one NOR gate being connected to the other input to said first NOR gate, and a second electric relay connected in circuit with said solenoid and said OR gate and operable in response to energization of said first relay for closing said valve to energize said solenoid to move said flag to provide a visual signal of the valve closing.

24. A system according to claim 19 including a primary direct current battery connected to provide current for said system, a secondary direct current battery connected to provide current for said system, a switch connected to said batteries to select the battery supplying current to said system, and solar electric power generating means connected to said batteries to charge the same.

25. A safety valve apparatus for use in a system for a hydrocarbon storage tank having a floating roof, a water drain in said roof, a drain opening from said tank, and a flexible line connecting said roof drain to said tank drain for carrying off rain water collected on said floating roof and preventing leakage of hydrocarbon liquid and through said tank drain, said apparatus comprising;

an electrically-operated, normally-closed valve means adapted to be connected in said tank drain, means responsive to pressure in said system exceeding a predetermined amount to maintain said valve means in a closed position for safety purposes until overridden, means responsive to the electrical conductivity of liquid on the inlet side of said valve means to detect the presence of water therein, and electric circuit means interconnecting said conductivity-responsive means and said electrically-operated valve means and operable to energize said valve means to open the same on detection of the presence of water in the inlet thereto.

26.

A safety valve apparatus for use in a system for a hydrocarbon storage tank having a floating roof, a water drain in said roof, a drain opening from said tank, and a flexible line connecting said roof drain to said tank drain for carrying off rain water collected on said floating roof and preventing leakage of hydrocarbon liquid and through said tank drain, said apparatus comprising;

an electrically-operated, normally-closed valve means adapted to be connected in said tank drain, means responsive to the electrical conductivity of liquid on the inlet side of said valve means to detect the presence of water therein, electric circuit means interconnecting said conductivity-responsive means and said electrically-operated valve means and operable to energize and valve means to open the same on detection of the presence of water in the inlet thereto, a primary power supply for operating said valve means, a secondary power supply operative in responsive to the failure of said primary power supply for operating said valve means, and means adapted to be connected to an external power source for continuously charging said primary and secondary power supply.

27. A valve apparatus according to claim 26 including means responsive to the operation of said secondary power supply for signaling its operation and maintaining said valve means in a closed position, and means responsive to the pressure in said valve means exceeding a predetermined limit for maintaining the same in a closed position.

28. A valve apparatus according to claim 27 in which said means responsive to electrical conductivity for detecting the presence of water in said drain line comprises a pair of electrodes extending into the interior of the inlet of said valve means, means connecting a source of direct current between said electrodes, and means responsive to the flow of current between said electrodes through said water.

29. A valve apparatus according to claim 27 in which said means sensing the pressure in said valve means comprises pressure sensing means in communication with the interior of the inlet of said valve means, means connecting a source of direct current to said device, and means responsive to the pressure above a predetermined level for by-passing said means for continuously measuring electrical conductivity.

30. A valve apparatus according to claim 26 in which said primary and secondary power supplies comprise storage batteries.

31. A valve apparatus according to claim 26 in which said electrically operated valve means comprises a gate valve and electric motor operatively connected thereto.

32.

A safety valve apparatus for use in a system for a hydrocarbon storage tank having a floating roof, a water drain in said roof, a drain opening from said tank, and a flexible line connecting said roof drain to said tank drain for carrying off rain water collected on said floating roof and preventing leakage of hydrocarbon liquid and through said tank drain, said apparatus comprising;

an electrically-operated, normally-closed valve means adapted to be connected in said tank drain, means responsive to the electrical conductivity of liquid on the inlet side of said valve means to detect the presence of water therein, and electric circuit means interconnecting said conductivity-responsive means and said electrically-operated valve means and operable to energize said valve means to open the same on detection of the presence of water in the inlet thereto, a normally-open, motor-operated gate valve adapted to be positioned in said drain, an electric motor operatively connected to said valve and operable to open and close the same, a pair of sensors adapted to be positioned in the inlet to said valve to detect electric conductivity of liquid therein and permitting a flow of current when immersed in water, an electric relay adaptedto be connected to said motor and operable to energize said motor to move said valve to an open or a closed position, a plurality of NOR gates and a field effect transistor interconnected in circuit with said sensors and said relay and operable on current flow between said sensors in the presence of water to actuate said relay to energize said motor to open said valve and operable in the absence of current flow between said sensors to energize said motor to close said valve.

33. A valve apparatus according to claim 32 including pressure responsive means positioned in the inlet to said valve to respond to pressure therein and including means operatively connected to one of said NOR gates whereby the occurrence of a selected pressure effects operation of said relay to energize said motor to close said valve.

34. A valve apparatus according to claim 32 including a signal flag, an electric solenoid operatively connected to said signal flag to operate the same, a second electric relay connected in circuit with said solenoid and said NOR gates and operable in response to energization of said first relay for closing said valve to energize said solenoid to move said flag to provide a visual signal of the valve closing.

35. A valve apparatus according to claim 33 in which one of said NOR gates has its output connected to the collector of said transistor and has its input from said sensors, three additional NOR gates being connected in series with the output from the first and second gate being connected to the input to the second and third gates, said pressure responsive means being connected to one input to said first NOR gate, and the output from said one NOR gate being connected to the other input to said first NOR gate.

36. A valve apparatus according to claim 33 including a signal flag, an electric solenoid operatively connected to said signal flag to operate the same, one of said NOR gates has its output connected to the collector of said transistor and has its input from said sensors, three additional NOR gates being connected in series with the output from the first and second gate being connected to the input to the second and third gates, said pressure responsive means being connected to one input to said first NOR gate, the output from said one NOR gate being connected to the other input to said first NOR gate, and a second electric relay connected in circuit with said solenoid and said third NOR gate and operable in response to energization of said first relay for closing said valve to energize said solenoid to move said flag to provide a visual signal of the valve closing.

37. A safety valve apparatus for use in a system for a hydrocarbon storage tank having a floating roof, a water drain in said roof, a drain opening from said tank, and a flexible line connecting said roof drain to said tank drain for carrying off rain water collected on said floating roof and preventing leakage of hydrocarbon liquid and through said tank drain, said apparatus comprising;

an electrically-operated, normally-closed valve means adapted to be connected in said tank drain, means responsive to the electrical conductivity of liquid on the inlet side of said valve means to detect the presence of water therein, and electric circuit means interconnecting said conductivity-responsive means and said electrically-operated valve means and operable to energize said valve means to open the same on detection of the presence of water in the inlet thereto, a normally-open, motor-operated gate valve adapted to be positioned in said drain, an electric motor operatively connected to said valve and operable to open and close the same, a pair of sensors adapted to be positioned in the inlet to said valve to detect electric conductivity of liquid therein and permitting a flow of current when immersed in water, an electric relay connected to said motor and operable to energize said motor to move said valve to an open or a closed position, a plurality of NOR gates, an OR gate, and a field effect transistor interconnected in circuit with said sensors and said relay and operable on current flow between said sensors in the presence of water to actuate said relay to energize said motor to open said valve and operable in the absence of current flow between said sensors to energize said motor to close said valve.

* * * * *